US006568012B2

(12) United States Patent
Michaelis et al.

(10) Patent No.: US 6,568,012 B2
(45) Date of Patent: May 27, 2003

(54) INFLATABLE MATTRESS WITH STORAGE COMPARTMENT

(75) Inventors: Susan Michaelis, Wichita, KS (US); Douglas Casto, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/924,352

(22) Filed: Aug. 7, 2001

(65) Prior Publication Data

US 2003/0028972 A1 Feb. 13, 2003

(51) Int. Cl.[7] ..... A47C 27/08
(52) U.S. Cl. ..... 5/706; 5/413 AM; 5/655.3
(58) Field of Search ..... 5/631, 639, 413 AM, 5/706, 707, 710, 735, 654, 655.3, 733, 731; 472/128, 129; 441/129

(56) References Cited

U.S. PATENT DOCUMENTS

| | | | | |
|---|---|---|---|---|
| 867,464 A | | 10/1907 | Abbott | |
| 1,548,728 A | * | 8/1925 | Milam | 5/722 |
| 2,462,579 A | * | 2/1949 | Warner | 5/722 |
| 4,097,944 A | | 7/1978 | Yulish | |
| 4,590,632 A | | 5/1986 | Meyer | |
| 4,693,691 A | * | 9/1987 | DeYoe | 5/694 |
| 4,737,999 A | | 4/1988 | Halverson | |
| 4,841,587 A | | 6/1989 | Carter et al. | |
| 5,072,467 A | | 12/1991 | Hunt | |
| 5,101,823 A | * | 4/1992 | Smith | 5/419 |
| 5,185,897 A | | 2/1993 | Van Laanen | |
| D335,999 S | | 6/1993 | Van Driessche | |
| 5,279,009 A | | 1/1994 | Putka, Jr. | |
| 5,443,880 A | | 8/1995 | Wike | |
| 5,720,061 A | | 2/1998 | Giori et al. | |
| D392,145 S | | 3/1998 | Thurston | |
| 5,896,605 A | | 4/1999 | Branman | |
| 6,178,574 B1 | | 1/2001 | Stromatt et al. | |
| 6,202,233 B1 | | 3/2001 | Achong | |
| 6,233,768 B1 | | 5/2001 | Harding | |

FOREIGN PATENT DOCUMENTS

| | | | |
|---|---|---|---|
| EP | 478475 | * | 4/1992 |

* cited by examiner

*Primary Examiner*—Frederick L. Lagman

(57) ABSTRACT

An air mattress is formed with a deep pocket adjacent one end portion for storing and concealing various items such as glasses, wallets, flashlights and the like. An inflatable pillow or similar cover member is tethered at one end to the mattress with a flexible hinge and connected to the mattress at its other end with a releasable connection which positions and holds the pillow over the storage pocket so as to cover and conceal the storage pocket.

20 Claims, 2 Drawing Sheets

FIG. 1
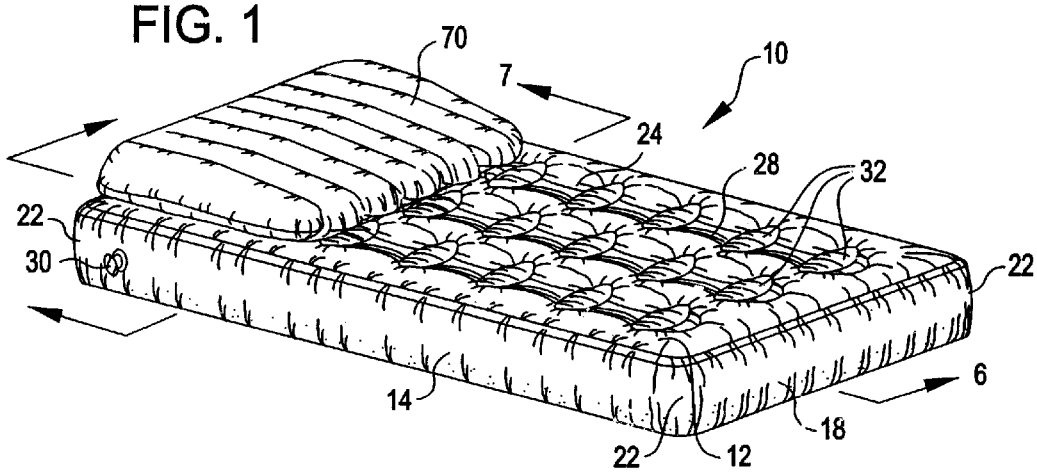
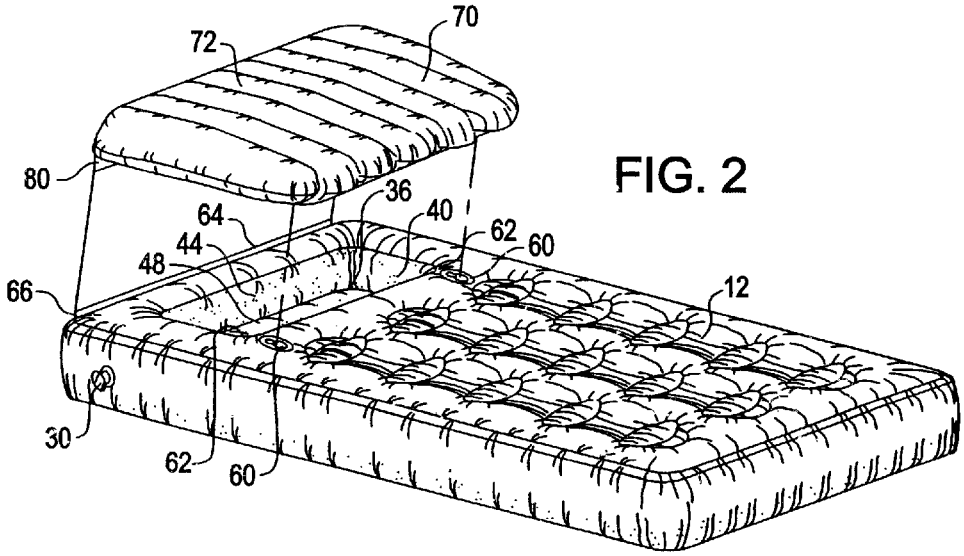
FIG. 2
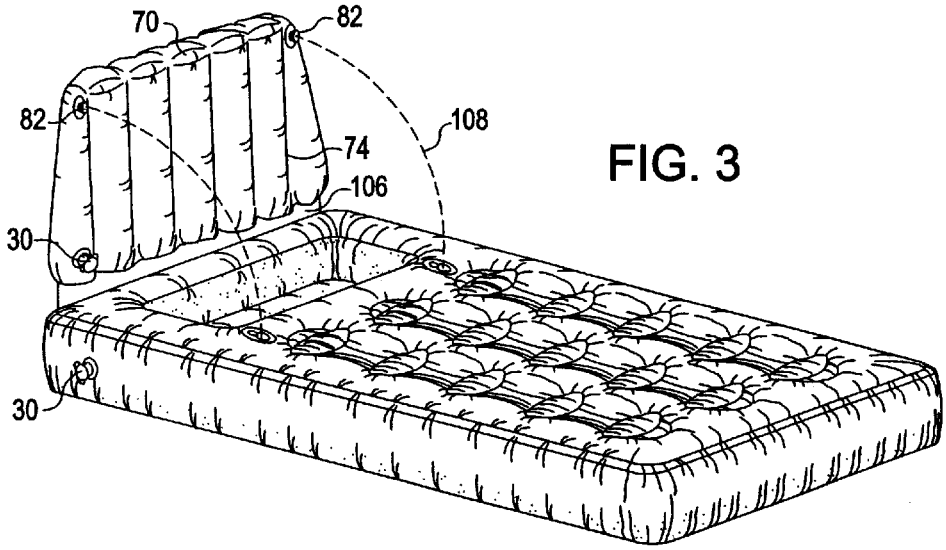
FIG. 3

INFLATABLE MATTRESS WITH STORAGE COMPARTMENT

BACKGROUND OF THE INVENTION

1. Field of the Invention

The present invention relates in general to inflatable pads and mattresses and in particular to a plastic air mattress having a storage compartment with a removable cover.

2. Description of Prior Developments

Inflatable pads and air mattresses are presently available in numerous sizes and shapes. Although these products generally function adequately, they do not have the ability to securely hold, store, protect, cover and conceal various items typically carried by outdoor enthusiasts such as campers, hikers and boaters.

A particular need exists for an inflatable mattress having a storage compartment for storing articles typically carried or used by a camper on an overnight trip. That is, when a camper turns in for the night, articles such as eyeglasses, wallets, purses, keys, flashlights, pocket change, clothing and the like are typically left unprotected and loosely lying about. It would be advantageous to be able to securely store such items such that their location is readily and easily accessible and such that the items are covered, protected from the environment and concealed so as to reduce the risk of damage, loss and theft.

SUMMARY OF THE INVENTION

The present invention has been developed to meet the needs noted above and therefore has as an object the provision of an inflatable article having a preformed storage compartment for holding and securing items in a known location.

Another object of the invention is the provision of an inflatable air mattress having an integral storage compartment which is formed by and during inflation of the mattress.

Yet another object of the invention is the provision of an inflatable pad, mattress or similar article or support which includes a storage compartment and a cover for covering, protecting and concealing various personal items typically used by an outdoor enthusiast.

Still another object of the invention is the provision of an inflatable air mattress having a storage compartment and an inflatable pillow or pad which provides support to a user's head and also serves as a removable cover or lid for closing and concealing a recessed compartment formed adjacent an end portion of the mattress.

These and other objects are met in accordance with the present invention which is directed to an inflatable mattress, pad, support or similar inflatable article having a storage compartment formed by inflation with a gas, such as air. In one embodiment, an inflatable air mattress is formed with a recess or pocket located adjacent one longitudinal end portion of the mattress.

The recess or pocket may be positioned at a location corresponding to a user's head when a user is laying prone on the mattress. A cover, in the form of an inflatable pad or pillow is dimensioned and shaped to overlie, cover, protect and conceal the recess, and also serve as a pillow.

The cover may be removably attached or connected to the mattress so as to cover the recess. Any number of various connectors such as snap-fit connectors, plug and socket connectors, hook and loop connectors, zippers, buttons, tongue and groove connectors, ties such as cords, elastic loops and anchor posts, and any other suitable releasable connection can be used between the cover and mattress. The cover may also be tethered to the mattress with a flexible web of plastic material or tethered with straps, belts, cords and the like, or the cover may be completely detachable and free from the mattress.

While the mattress is primarily intended for use as a resting and sleeping support for overnight camping and other outdoor or away-from-home activities, the mattress may also serve as a flotation device for aquatic use. When the cover is positioned in place by the connectors, the presence of the storage compartment is hidden and concealed from normal view.

The aforementioned objects, features, and advantages of the invention will, in part, be pointed out with particularity, and will, in part, become clear from the following more detailed description of the invention taken in conjunction with the accompanying drawings, which form an integral part thereof.

BRIEF DESCRIPTION OF THE DRAWINGS

In the drawings:

FIG. 1 is a perspective view of an inflatable mattress having a non-detachable tethered pillow constructed in accordance with a first embodiment of the invention;

FIG. 2 is an exploded perspective view similar to FIG. 1 showing a detachable pillow fully detached from the mattress and showing the details of interconnection between the pillow and the mattress;

FIG. 3 is a perspective view similar to FIG. 1 wherein the pillow is shown pivotally tethered to the mattress with a living hinge formed of web of plastic material;

In the various views of the drawings, like reference characters designate like or similar parts.

DETAILED DESCRIPTION OF THE PREFERRED EMBODIMENTS

The present invention will now be described in conjunction with the drawings, beginning with FIG. 1 which shows an inflatable mattress and pillow support assembly 10 constructed in accordance with a first embodiment of the invention. Assembly 10 includes an inflatable pad or mattress support 12 having a generally rectangular parallelepiped configuration.

Figure 6:
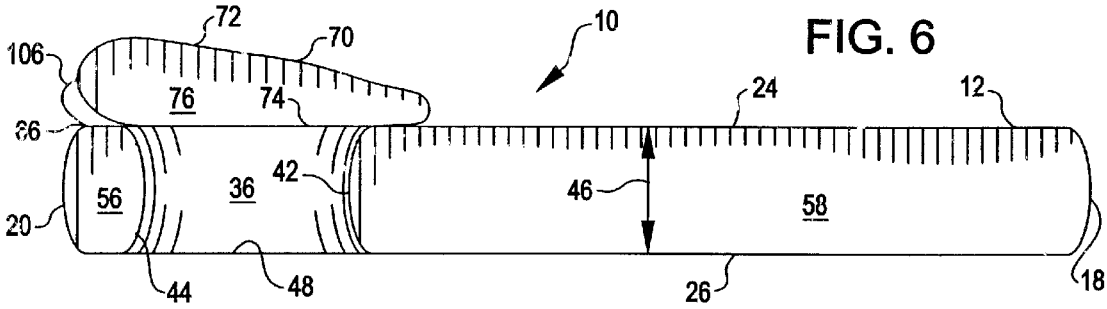
FIG. 6 is a view in section, taken through longitudinal section line 6—6 of FIG. 1.

Mattress 12 includes a pair of upstanding or vertical longitudinally-extending side walls 14, 16 (FIG. 7) and a pair of upstanding or vertical transversely-extending end walls 18, 20 (FIG. 6). The sidewalls 14, 16 join the end walls 18, 20 at four rounded corners 22. The mattress 12 further includes an upper or top support surface 24 and a lower or bottom support surface 26 (FIG. 6). Any one of several well-known plastic sheet materials may be used to fabricate mattress 12 in a generally known fashion. A layer of flocked plastic material or similar fabric 28 may be applied to the upper support surface 24 to provide a plush appearance and to increase surface friction and resist sliding over surface 24.

Mattress 12 is preferably formed as an inflatable "air" mattress which can be inflated with a gas such as ambient air using a conventional air pump or other suitable means. A conventional valve 30 is provided in, for example, sidewall 14 for receiving the nozzle of an air pump or the like. An array of shallow embossed recesses or dimples 32 is formed on the upper surface 24 and lower surface 26 of mattress 12 by internal strips of plastic material which are bonded to and extend between these surfaces in a known manner to prevent the mattress from ballooning outwardly.

As seen in FIG. 2, mattress 12 is formed with a storage compartment 36, preferably located adjacent one end wall 18, 20. In the embodiment shown in FIG. 2, compartment 36 is formed adjacent end wall 20 as a generally rectangular basin or pocket having a pair of opposed upstanding longitudinally-extending interior lateral walls 38, 40 (FIG. 7) and a pair of opposed upstanding transversely-extending interior transverse walls 42, 44 (FIG. 6).

The four internal compartment walls 38–44 extend from the lower support surface 26 upwardly to the upper support surface 24 and thereby define a deep pocket having a depth substantially equal to the inflated thickness of the mattress 12 as represented by arrow 46 in FIG. 6. Although compartment 36 is shown having a rectangular section or shape, it can be formed with any perimeter form or shape, such as round, oval, polygonal or irregular.

The storage compartment 36 further includes a base or floor 48. In the example shown, floor 48 is simply a rectangular portion of the lower surface 26 extending between the walls 38–44. In this manner, a thin web or sheet of plastic material serves as floor 48. The internal walls 38–44 are likewise formed of a thin sheet of plastic material.

By locating storage compartment 36 adjacent an end portion of mattress 12 near an end wall such as end wall 20, three relatively small interconnected tubular air channel segments 50, 52, 54 are defined around three sides of the storage compartment 36 and a larger air chamber 58 is defined adjacent the innermost transverse wall 42 and the opposite end wall 18. For reasons discussed below, it is preferable to locate storage compartment 36 within that interior portion of air mattress 12 that corresponds to the general location of one's head when one is lying prone on top of the mattress.

Mattress 12 further includes a pair of interior connector members 60 located adjacent the respective interior corners 62 of storage compartment 36. Another connector member 64 is provided along the top edge 66 of end wall 20. In the example shown in FIG. 2, connector member 64 is a detachable type of connector such as a half zipper strip or a strip of hook-and-loop fabric type connector.

The purpose of connector members 60, 64 is to detachably anchor and release pillow 70 to and from the mattress 12. Pillow 70 is preferably formed as an inflatable pad, although it may be formed as a batting-stuffed head support or simply a sheet of plastic material. Preferably, pillow 70 includes a conventional air valve 30 (FIG. 3) for inflating the pillow in a known fashion.

Pillow 70 may take any form or shape. In the examples shown, pillow 70 is generally trapezoidal in top and bottom plan views, and generally longitudinally inwardly tapering or wedge-shaped in side elevation views as positioned on mattress 12. Pillow 70 includes a corrugated or furrowed top surface 72 and a corrugated or furrowed bottom surface 74 (FIG. 6).

Figure 7:
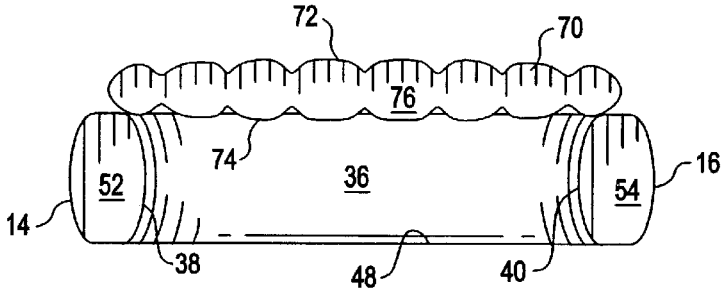
FIG. 7 is a view in section, taken through transverse section line 7—7 of FIG. 1.

As seen in FIGS. 6 and 7, the pillow 70 can be formed with a single internal cavity or air chamber 76. The pillow 70 is dimensioned to completely cover and overlie the storage compartment 36 so as to form a closed storage compartment. Preferably, the pillow 70 substantially overlies all or a portion of air channel segment 56 and all or portions of air channel segments 52 and 54, as well as a small portion of air chamber 58.

In this manner, when the pillow 70 is placed over storage compartment 36, the storage compartment is completely covered and concealed from normal view by the overlapping pillow. The correct positioning and alignment of the pillow 70 over the storage compartment 36 is ensured by connector members 80 and 82 (FIGS. 2 and 3–5). Connector member 80 detachably mates with complimentary connector member 64 and therefore may be respectively formed as a half zipper strip or a strip of hook and loop fabric fastener.

The connector members 82 are shown as rigid plastic pin members having a shaft 84 and an enlarged head 86. Each connector member 82 also includes a planar base 88 which is bonded or otherwise fixed to the bottom surface 74 of pillow 70. The connector members 60 are located on the mattress 12 so as to align with and freely receive the shaft and head of each respective connector member 82.

Figure 4:
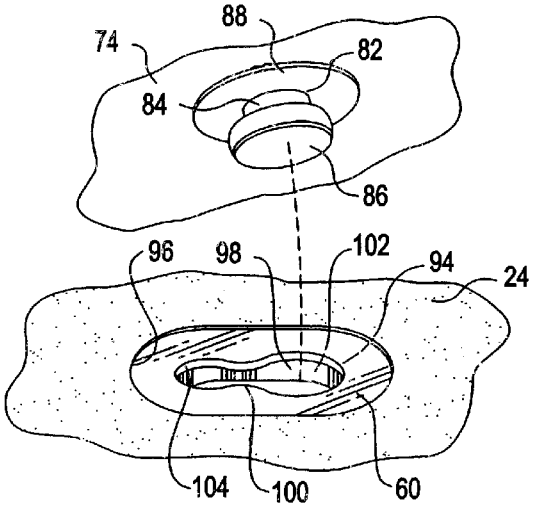
FIG. 4 is an exploded partial perspective view of a plug and socket retainer assembly for securing the pillow to the mattress over the storage compartment.
Figure 5:
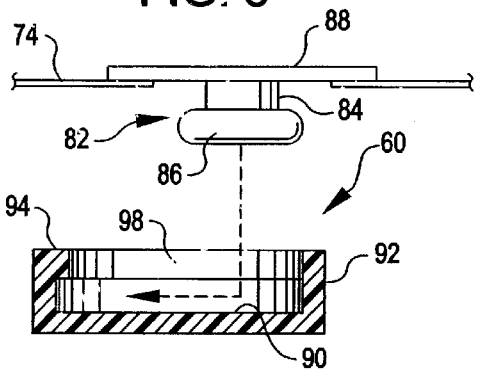
FIG. 5 is an exploded partial side elevation view, partly in section, showing the manner of insertion of the plug into the socket of the retainer assembly of FIGS. 3 and 4.

As further seen in FIGS. 4 and 5, each connector member 60 is formed as a rigid plastic socket or cup having a floor 90, a sidewall 92 and a roof 94. Roof 94 is bonded or otherwise attached within chamber 58 to the upper support surface 24 of mattress 12, and is accessible through an aperture 96 formed therein.

A contoured slot 98 is formed in roof 94 of connector member 60 for receiving the shaft and head of connector member 82. A necked down region 100 of roof 94 defines a generally figure-eight shaped slot 98. The head 86 of connector member 82 is dimensioned to pass freely into an enlarged opening 102 in slot 98 and the cylindrical shaft 84 is dimensioned to resiliently pass through the necked down region 100 with a snap-fit over-center action.

In this manner, the shaft of connector member 82 is held rigidly within a small opening 104 of slot 98. The connector member 82 is axially held within connector member 60 by head 86 which is larger than the small opening 100. The connector member 82 can be removed from the socket of connector member 60 with a reverse movement through the necked down region 100 and out through the enlarged opening 102.

Instead of fully and freely detachably connecting the pillow 70 to the mattress 12, it is possible to permanently connect the pillow 70 to the mattress 12 with a tethered connection such as shown in FIG. 3. A strip or web 106 of thin flexible plastic material is bonded at one longitudinal end portion to mattress 12 and at its other longitudinal end portion to the pillow 70 so as to form a flexible living hinge between the pillow 70 and mattress 12. As further seen in FIG. 3, the pillow 70 can be pivoted over the storage compartment 36 along an arc defined by dashed lines 108.

When the pillow 70 overlies and overlaps the storage compartment 36 in a symmetrical centered position over compartment 36, as shown in FIGS. 1 and 6, the storage compartment 36 is completely concealed from normal view. Items stored in the compartment 36 are securely held therein by pillow 70, which is properly positioned on mattress 12 so as to support one's head in a normal sleeping or resting position on mattress 12. The connector members 60, 82 snugly and securely hold the pillow 70 against the mattress 12 so as to positively prevent items stored in the compartment from falling out.

There has been disclosed the best embodiment of the invention presently contemplated. However, it is to be understood that various changes and modifications may be made thereto without departing from the spirit of the invention, as defined by the appended claims.

For example, connectors 60 and 82 can be formed as complimentary hook and loop type fabric fasteners, circular snap connectors of the type used in clothing, or any other suitable connector. The same applies for connectors 64 and 80.

What is claimed is:

1. An inflatable support, comprising:

a mattress portion having a storage compartment formed therein; and a pillow portion disposed on said mattress portion and adapted to completely cover and overlie said storage compartment so as to conceal said storage compartment.

2. The support of claim 1, wherein said mattress portion comprises an inflatable air mattress having a top surface, wherein said storage compartment comprises a compartment pocket formed in said mattress portion, wherein said pillow portion comprises an inflatable pillow having a bottom surface sized to completely cover and overlie said storage compartment and overlap said top surface of said mattress disposed adjacent said storage compartment, and wherein said bottom surface of said pillow portion covering said storage compartment and said mattress portion define said compartment pocket.

3. The support of claim 1, further comprising a first connector provided on said mattress portion and a second connector provided on said pillow portion for connecting said pillow portion to said mattress portion.

4. The support of claim 1, further comprising a releasable connection provided between said mattress portion and said pillow portion.

5. The support of claim 4, wherein said releasable connection comprises a pin and socket connection.

6. The support of claim 4, wherein said releasable connection comprises a hook and loop fastener connection.

7. The support of claim 1, wherein said storage compartment is located in an interior portion of said mattress portion and further comprising an air channel bordering said storage compartment.

8. The support of claim 1, wherein said storage compartment comprises a first side and a second side, and wherein said support further comprises a first connection interconnecting said mattress and pillow adjacent said first side of said storage compartment and a second connection interconnecting said mattress portion and pillow portion adjacent said second side of said storage compartment.

9. The support of claim 8, wherein the first connection is a permanent connection and wherein the second connection is a releasable connection.

10. An air mattress and pillow assembly, comprising:

an inflatable air mattress;

an inflatable pillow;

a first connection formed between said air mattress and said pillow; and a storage compartment for storing articles having a compartment pocket, wherein said pillow overlies said compartment pocket when connected to said air mattress, and wherein said compartment pocket is closed and defined by said connected inflatable pillow and said air mattress.

11. The assembly of claim 10, wherein said first connection is a releasable connection and is located adjacent said storage compartment.

12. The assembly of claim 11, further comprising a permanent connection formed between said mattress and said pillow.

13. The assembly of claim 11, wherein said releasable connection comprises a snap fit connection.

14. The assembly of claim 11, wherein said releasable connection comprises a pin and socket connection.

15. The assembly of claim 10, wherein said mattress has a top surface and a bottom surface, and wherein said storage compartment extends from said top surface of said mattress to said bottom surface of said mattress.

16. A mattress and cover assembly, comprising:

an inflatable air mattress having first and second longitudinally-spaced end portions;

a cover member connected to said air mattress;

a storage compartment formed in said air mattress adjacent one of said end portions; and a releasable connection provided between said air mattress and said cover member for positioning and holding said cover member adjacent said storage compartment with said cover member completely covering and overlying said storage compartment so as to conceal said storage compartment.

17. The assembly of claim 16, further comprising a flexible hinge interconnecting said cover member to said one end portion of said mattress.

18. The assembly of claim 16, wherein said mattress has a top surface and a bottom surface and wherein said storage compartment extends from said top surface to said bottom surface.

19. The assembly of claim 16, wherein said air mattress comprises a plurality of air channel segments bordering said storage compartment.

20. The assembly of claim 19, wherein said cover member comprises an inflatable pillow overlying at least a portion of each of said plurality of air channel segments.

* * * * *